US011148850B2

(12) United States Patent
Jun

(10) Patent No.: US 11,148,850 B2
(45) Date of Patent: Oct. 19, 2021

(54) PACKAGING BOX

(71) Applicant: EYEMEE THE BEAUTY CO., LTD., Seoul (KR)

(72) Inventor: Joon Hee Jun, Gyeonggi-do (KR)

(73) Assignee: EYEMEE THE BEAUTY CO., LTD., Seoul (KR)

( * ) Notice: Subject to any disclaimer, the term of this patent is extended or adjusted under 35 U.S.C. 154(b) by 0 days.

(21) Appl. No.: 16/767,202

(22) PCT Filed: Jun. 1, 2018

(86) PCT No.: PCT/KR2018/006265
§ 371 (c)(1),
(2) Date: May 27, 2020

(87) PCT Pub. No.: WO2019/107684
PCT Pub. Date: Jun. 6, 2019

(65) Prior Publication Data

US 2020/0391900 A1 Dec. 17, 2020

(30) Foreign Application Priority Data

Nov. 28, 2017 (KR) ..... 10-2017-0160381

(51) Int. Cl.
*B65D 5/42* (2006.01)
*B65D 5/02* (2006.01)
*B65D 5/10* (2006.01)

(52) U.S. Cl.
CPC ..... *B65D 5/4208* (2013.01); *B65D 5/0227* (2013.01); *B65D 5/0254* (2013.01); *B65D 5/106* (2013.01)

(58) Field of Classification Search
CPC .... B65D 5/0254; B65D 5/106; B65D 5/6608; B65D 5/6655; B65D 5/6658; B65D 5/4208; B65D 5/0227
(Continued)

(56) References Cited

U.S. PATENT DOCUMENTS 4,184,597 A * 1/1980 Gavin ..... B65D 5/5415 229/230
4,201,292 A * 5/1980 Davidson ..... B65D 5/4208 206/45.23

(Continued)

FOREIGN PATENT DOCUMENTS

CN 204236876 4/2015
JP 05-254539 10/1993

(Continued)

OTHER PUBLICATIONS

International Search Report dated Aug. 29, 2018 for PCT/KR2018/006265.

(Continued)

*Primary Examiner* — Nathan J Newhouse
*Assistant Examiner* — Phillip D Schmidt

(57) ABSTRACT

The present invention relates to a packaging box enabling a storage form and a hanging form to be simply switched, thereby enabling a perfect rectangular shape to be maintained without exposing a hanging part during a distribution process or when the packaging box is erected and displayed on a display stand, and enabling the packaging box to be hung and displayed on a rack.

4 Claims, 4 Drawing Sheets

(58) Field of Classification Search
USPC ..... 229/117.18, 141, 142, 149, 414, 117.24; 206/806
See application file for complete search history.

(56) References Cited

U.S. PATENT DOCUMENTS

D265,551 S * 7/1982 Colby ..... D9/415
4,863,052 A * 9/1989 Lambert ..... B65D 5/46088 229/117.3
5,096,114 A * 3/1992 Higginbotham ..... A61B 50/36 206/366
5,356,022 A * 10/1994 Tipps ..... B65D 5/10 206/366

FOREIGN PATENT DOCUMENTS

| | | |
|---|---|---|
| JP | 2504703 | 4/1996 |
| JP | 10-175630 | 6/1998 |
| JP | 2014-015221 | 1/2014 |
| JP | 2017-178362 | 10/2017 |
| KR | 20-2009-0004390 | 5/2009 |
| KR | 20-2009-0005375 | 6/2009 |
| KR | 20-2011-0000645 | 1/2011 |

OTHER PUBLICATIONS

Korean Office Action dated Nov. 14, 2018 corresponding to Korean Patent Application No. 10-2017-0160381.
Korean Notice of Allowance dated Jun. 13, 2019 corresponding to Korean Patent Application No. 10-2017-0160381.

* cited by examiner

PACKAGING BOX

This application claims the priority of Korean Patent Application No. 10-2017-0160381, filed on Nov. 28, 2017 in the KIPO (Korean Intellectual Property Office), the disclosure of which is incorporated herein entirely by reference. Further, this application is the National Stage application of International Application No. PCT/KR2018/006265, filed Jun. 1, 2018, which designates the United States and was published in Korean. Each of these applications is hereby incorporated by reference in their entirety into the present application.

TECHNICAL FIELD

The present invention relates to packaging boxes, and more particularly, to a packaging box having both a function of packaging and storing a product and a function of hanging a packaging box on a hanger and displaying the packaging box.

BACKGROUND ART

In general, a box that packages a product is distributed in a state of being accommodated in large quantities in a large box, and is kept in a storage.

The box that packages a product is put on a display stand for sale to consumers or is hung on a rack so that the box can be easily seen by buyers. Hanging and displaying products on the rack is not only easy to organize, but also has the advantage of not having to immediately organize the display stand even when buyers take out products. However, in order to hang a product on a rack, a packaging box integrally formed with a hanging part is used, or a separate hanging part is attached to the packaging box.

Because attaching the hanging part to a packaging box separately is cumbersome to sellers, a packaging box in which the hanging part is formed is mainly used. However, because such a packaging box integrated with a hanging part is not in a rectangular shape, it is inconvenient to store this packaging box in a large box.

In addition, when a hanging part-integrated packaging box is put on a display stand, the hanging part-integrated packaging box is not neatly displayed due to the hanging part, and a displaying method is limited by the hanging part.

To address these problems, KR No. 20-2009-0009121 has been proposed as the conventional art. However, in the conventional art, it is inconvenient to manufacture because two separate members need to be combined, and the appearance of the packaging box is not neat because the hanging part is exposed to the outside.

DISCLOSURE OF THE INVENTION

Technical Problem

Provided is a packaging box maintaining a rectangular shape without exposing a hanging part during a distribution process or when displayed on a display stand, and providing the hanging part when the packaging box is hung on a rack.

Provided is also a packaging box capable of being assembled using one sheet of a development drawing to be simply manufactured.

Technical Solution

According to an aspect of the present disclosure, a rectangular packaging box includes a planar portion that may be open, and a left side portion, a right side portion, a front side portion, a back side portion, and a bottom side portion that are closed.

A first cover is a portion that extends upwards from the back side portion and is configured to cover the planar portion, and includes a cover portion that covers the planar portion and an insertion portion inserted into the packaging box.

The cover portion and the insertion portion of the first cover are distinguished by a folding line, and a through hole is formed in the insertion portion.

A second cover is a portion that extends upwards from the left side portion or the right side portion and is configured to cover the planar portion, and includes a cover portion that covers the planar portion and an insertion portion inserted into the packaging box.

The cover portion and the insertion portion of the second cover are distinguished by a folding line.

A cut-out portion is formed in a later side portion other than a lateral side portion from which the second cover extends, such that a portion of the insertion portion of the second cover is insertable into the cut-out portion.

When the packaging box is used in a storage form, the cover portion of the second cover is made cover the planar portion, the insertion portion of the second cover is made inserted into the packaging box, and the cover portion of the first cover is made cover the planar portion, and the insertion portion of the first cover is inserted into the packaging box.

When the packaging box is used in a hanging form, the first cover is unfolded, the cover portion of the second cover covers the planar portion, and the insertion portion of the second cover covers the outside of the lateral side portion and at this time a portion of the insertion portion of the second cover is inserted into the cut-out portion of the lateral side portion and fixed. In this state, the through hole of the insertion portion of the first cover is hung on a rack such that the packaging box is used in a hanging form.

Advantageous Effects

The present invention enables a storage form and a hanging form to be simply switched, thereby enabling a perfect rectangular shape to be maintained without exposing a hanging part during a distribution process or when a packaging box is erected and displayed on a display stand, and enabling the packaging box to be hung and displayed on a rack.

In addition, the packaging box can be manufactured by using a sheet formed in one unfolded view, so as to be easily manufactured and have all constituent elements connected without being separated, thereby resolving a problem in which some of the constituent elements deviate or are separated therefrom.

MODE FOR CARRYING OUT THE INVENTION

Figure 1:
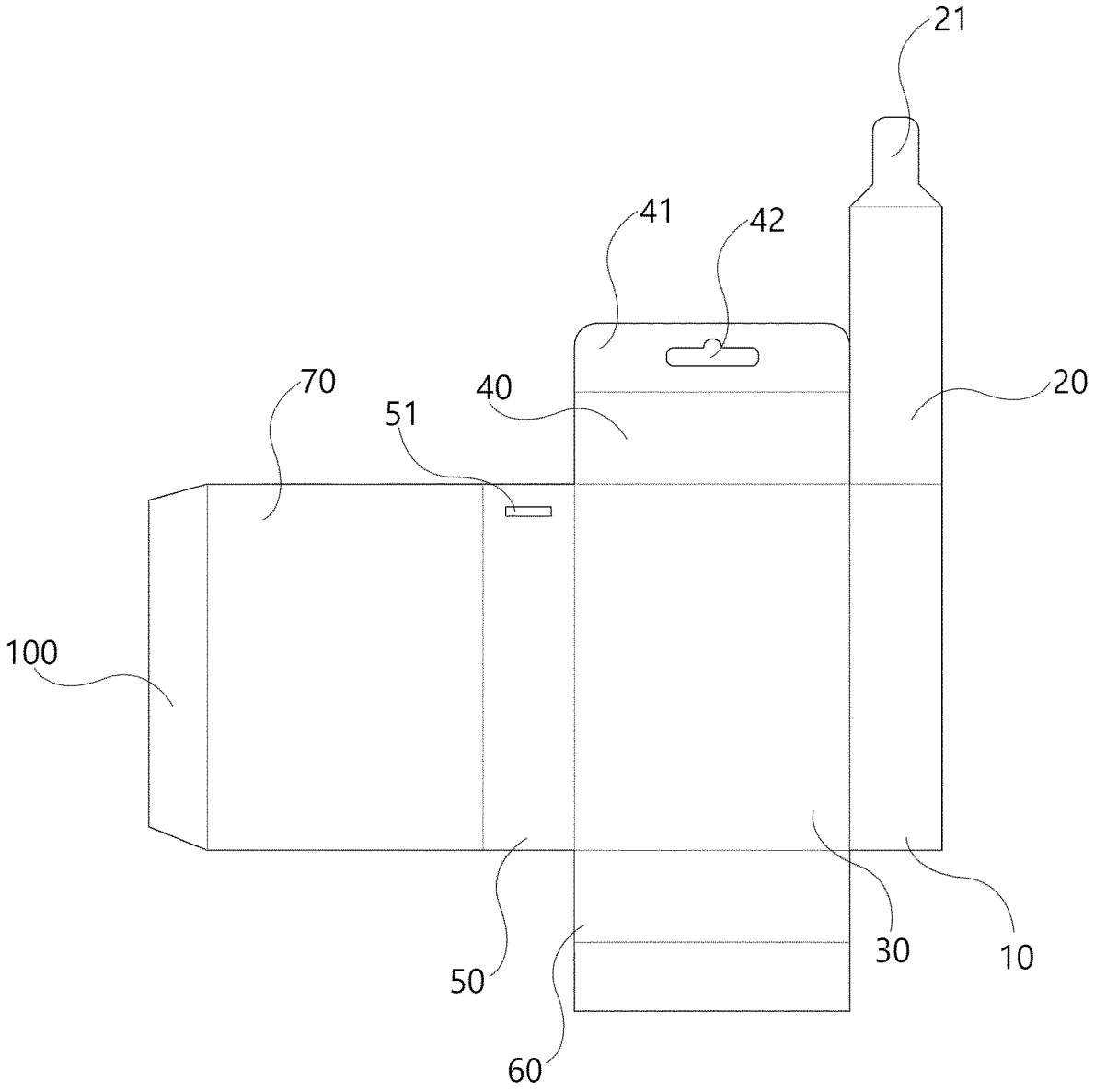
FIG. 1 is a development view of a packaging box according to an embodiment of the present invention.

The present invention will now be described more fully with reference to the accompanying drawings, in which exemplary embodiments of the present invention are shown. It is noted that, in the accompanying drawings, the same components are denoted by the same reference numerals as possible. In addition, detailed descriptions of well-known functions and configurations that may obscure the subject matter of the present invention will be omitted. For the same reason, some components in the attached drawings are omitted or schematically illustrated.

Figure 2:
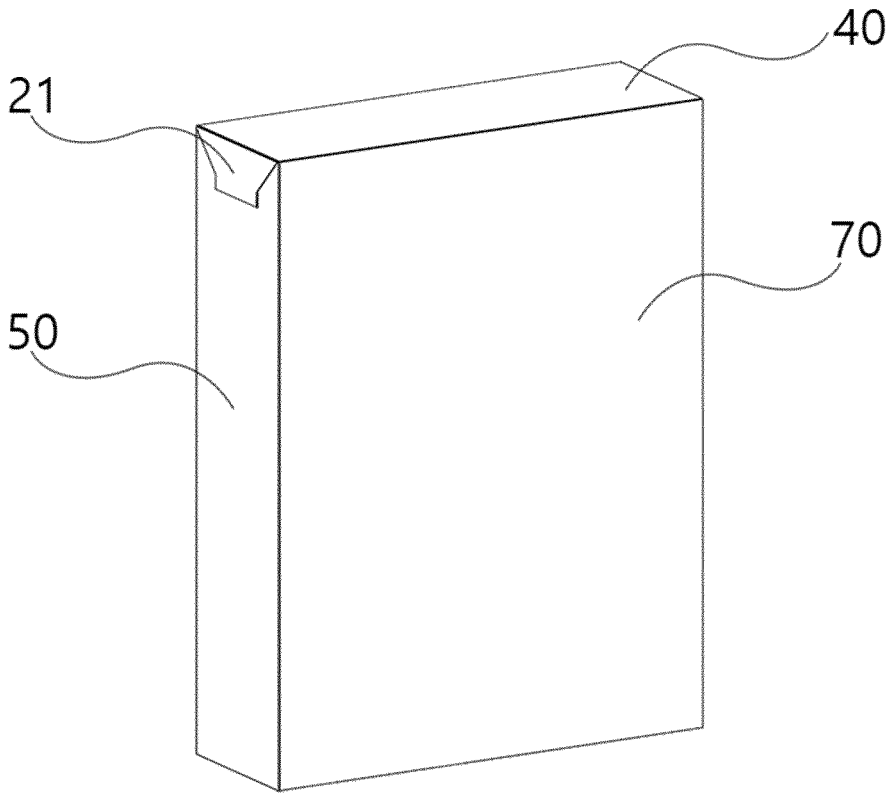
FIG. 2 is a perspective view of a usage state of the packaging box according to an embodiment of the present invention.
Figure 3:
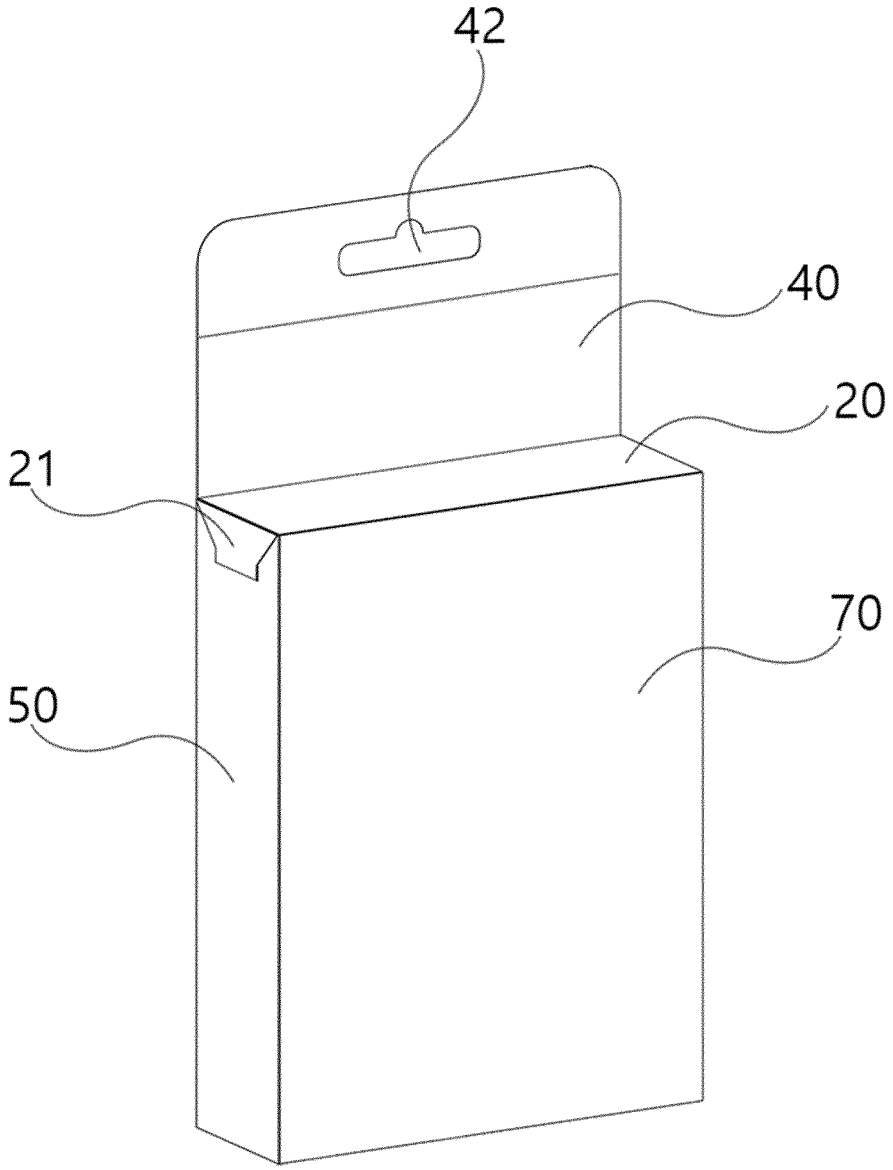
FIG. 3 is a perspective view of another usage state of the packaging box according to an embodiment of the present invention.

FIG. 1 is an unfolded view of a packaging box according to an embodiment of the present invention, FIG. 2 is a perspective view of the packaging box according to an embodiment of the present invention in a storage form, and FIG. 3 is a perspective view of the packaging box according to an embodiment of the present invention in a hanging form.

As shown in FIG. 1, the present invention may be manufactured by folding a single member formed in one unfolded view. In FIG. 1, thick lines indicate cutting lines, and thin lines indicate folding lines.

As shown in FIG. 1, the present invention includes a right side portion 10, second covers 20 and 21, a back side portion 30, first covers 40, 41, and 42, a left side portion 50, a bottom side portion 60, and a front side portion 70. According to an embodiment of the present invention, a six-sided rectangular box is manufactured by forming an attaching part 100 and attaching the attaching part 100 to the right side portion 10.

According to an embodiment of the present invention, a planar portion may be open by unfolding a first cover, and a left side portion, a right side portion, a front side portion, a back side portion, and a bottom side portion are designed to be closed.

According to an embodiment of the present invention, the packaging box is formed of paper. However, the packaging box may be formed of a synthetic resin material or may be formed of any material as long as the material can be processed in a plate-type unfolded view.

FIGS. 1 through 3 illustrate an embodiment in which a second cover is formed on the right side. However, in another embodiment, the second cover may be formed on the left side when the packaging box is manufactured using a mirror image-form unfolded view.

The right side portion 10 closes the right side of the packaging box.

A second cover portion 20 extends from the top of the right side portion 10.

A second cover insertion portion 21 extends from the top of the second cover portion 20.

Figure 4:
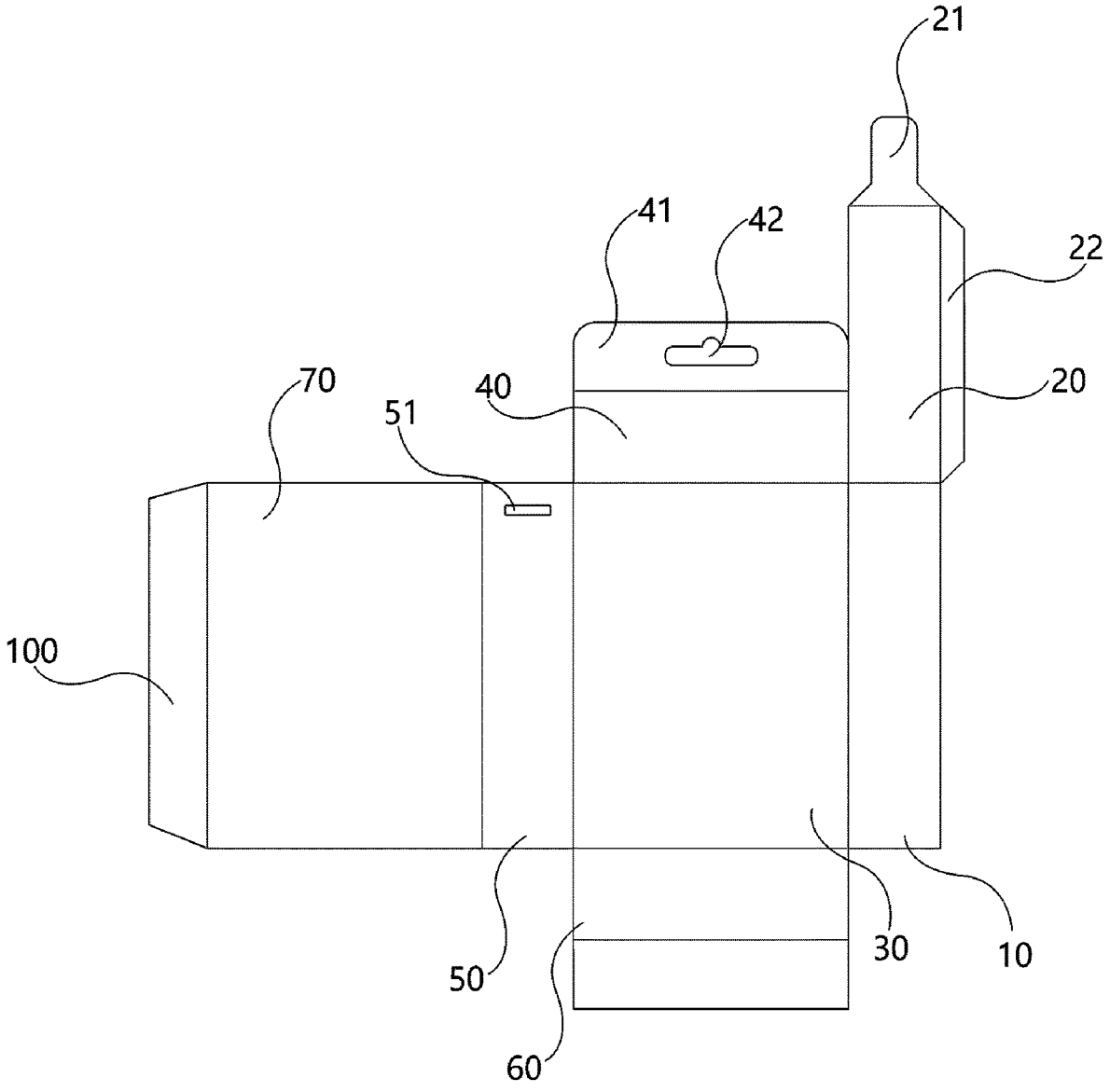
FIG. 4 is an unfolded view of a packaging box according to another embodiment of the present invention.

As shown in an unfolded view of FIG. 4, a second cover second-insertion portion 22 may extend from one lateral side of the second cover portion 20. The second cover second-insertion portion 22 is inserted into the front side portion such that the second cover may be more firmly fixed to a packaging box.

The back side portion 30 extends from the right side of the right side portion.

A first cover portion 40 extends from the top of the back side portion 30.

A first cover insertion portion 41 extends from the top of the first cover portion 40.

At this time, a through hole 42 into which a hanger is insertable is formed in the first cover insertion portion 41 and enables the hanger to be inserted thereinto when a product is displayed. The through hole 42 may have various shapes enabling the hanger to be inserted thereinto.

The left side portion 50 extends from the right side of the back side portion.

At this time, a cut-out portion 51 is formed in the left side portion 50 such that a portion of the second cover insertion portion 21 may be inserted into the cut-out portion 51. The cut-out portion 51 may be a rectangular hole type as shown in FIGS. 1 and 2, but may also be a simple line. Preferably, the width of the cut-out portion 51 is equal to or slightly greater than that of the second cover insertion portion 21.

The front side portion 70 extends from a lateral side of the left side portion.

The bottom side portion 60 is a portion that closes the bottom of the packaging box. According to an embodiment of the present invention, as shown in FIG. 1, the bottom side portion 60 extends from a lower side of the back side portion 30. However, the bottom side portion 60 may extend from various portions such as the left side portion 50, the right side portion 10, and the front side portion 70.

A method of using the packaging box having the above-described structure according to an embodiment of the present invention is as follows.

When the packaging box is used in a storage form, the second cover portion is made cover the planar portion and the first cover portion is then made cover the planar portion, and the first cover insertion portion is inserted into the packaging box.

When the packaging box is used in a hanging form, the first cover is unfolded, the second cover portion covers the planar portion, and the second cover insertion portion covers the outside of a lateral side portion and at this time a portion of the second cover insertion portion is inserted into a cut-out portion of the lateral side portion and fixed. In this state, a through hole of a first cover insertion portion is hung on a rack such that the packaging box is used in a hanging form.

DESCRIPTION OF REFERENCE NUMERALS

10: right side portion
20: second cover portion
21: second cover insertion portion
22: second cover second-insertion portion
30: back side portion
40: first cover portion
41: first cover insertion portion
42: first cover through hole
50: left side portion
51: cut-out portion
60: bottom side portion
70: front side portion
100: attaching part

The invention claimed is:

1. A packaging box having a six-sided rectangular shape for product packaging and having an empty inside, the packaging box configurable between a storage form and a hanging form, the packaging box comprising:

a right side portion;

a second cover portion extending from the top of the right side portion, the second cover portion having an unbroken interior surface, an unbroken exterior surface, and a thickness therebetween, the interior and exterior surfaces having a rectangular shape defined by four sides, the four sides being:

a fold line between the second cover portion and the right side portion, a fold line between the second cover portion and a second cover insertion portion, and two sides extending between the right side portion and the second cover insertion portion, the second cover insertion portion extending from the top of the second cover portion;

a back side portion extending from the right side of the right side portion;

a first cover portion extending from the top of the back side portion;

a first cover insertion portion extending from the top of the first cover portion;

a left side portion extending from the right side of the back side portion;

a front side portion extending from a lateral side of the left side portion; and a bottom side portion that closes the bottom of the packaging box, wherein a through hole into which a hanger is insertable is formed in the first cover insertion portion, wherein a cut-out portion is formed in the left side portion such that a portion of the second cover insertion portion is insertable into the cut-out portion, when the packaging box is used in a storage form, the first cover portion and the second cover portion cover the planar portion of the packaging box, the first cover insertion portion is inserted into the packaging box, and the second cover insertion portion is inserted in the cut-out portion, the second cover insertion portion at least partially covering the left side portion, when the packaging box is used in a hanging form, the first cover portion and the first cover insertion portion are unfolded, the second cover portion covers the planar portion of the packaging box, and the second cover insertion portion is inserted in the cut-out portion, the second cover insertion portion at least partially covering the left side portion.

2. A packaging box having a six-sided rectangular shape for product packaging and having an empty inside, the packaging box configurable between a storage form and a hanging form, the packaging box comprising:

a left side portion;

a second cover portion extending from the top of the left side portion, the second cover portion having an unbroken interior surface, an unbroken exterior surface, and a thickness therebetween, the interior and exterior surfaces having a rectangular shape defined by four sides, the four sides being:

a fold line between the second cover portion and the left side portion, a fold line between the second cover portion and a second cover insertion portion, and two sides extending between the left side portion and the second cover insertion portion, the second cover insertion portion extending from the top of the second cover portion;

a back side portion extending from a left side of the left side portion;

a first cover portion extending from the top of the back side portion;

a first cover insertion portion extending from the top of the first cover portion;

a right side portion extending from the left side of the back side portion;

a front side portion extending from a lateral side of the right side portion; and a bottom side portion that closes the bottom of the packaging box, wherein a through hole into which a hanger is insertable is formed in the first cover insertion portion, wherein a cut-out portion is formed in the right side portion such that a portion of the second cover insertion portion is insertable into the cut-out portion, when the packaging box is used in a storage form, the first cover portion and the second cover portion cover the planar portion of the packaging box, the first cover insertion portion is inserted into the packaging box, and the second cover insertion portion is inserted in the cut-out portion, the second cover insertion portion at least partially covering the right side portion, when the packaging box is used in a hanging form, the first cover portion and the first cover insertion portion are unfolded, the second cover portion covers the planar portion of the packaging box, and the second cover insertion portion is inserted in the cut-out portion, the second cover insertion portion at least partially covering the right side portion.

3. The packaging box of claim 1, further comprising a second cover second-insertion portion extending from a lateral side of the second cover portion.

4. The packaging box of claim 2, further comprising a second cover second-insertion portion extending from a lateral side of the second cover portion.

* * * * *